US008188392B2

(12) United States Patent
Isberg et al.

(10) Patent No.: US 8,188,392 B2
(45) Date of Patent: May 29, 2012

(54) SERRATED CONTACT MEMBERS

(75) Inventors: Peter Isberg, Västerås (SE); Joachim Glatz-Reichenbach, Tägerwilen (CH); Mats M Johansson, Västerås (SE); Krister Linnarud, Västerås (SE); Lars X Eriksson, Västerås (SE)

(73) Assignee: ABB AB (SE)

( * ) Notice: Subject to any disclaimer, the term of this patent is extended or adjusted under 35 U.S.C. 154(b) by 592 days.

(21) Appl. No.: 12/225,557

(22) PCT Filed: Mar. 23, 2007

(86) PCT No.: PCT/EP2007/052802

§ 371 (c)(1),
(2), (4) Date: Sep. 24, 2008

(87) PCT Pub. No.: WO2007/110388

PCT Pub. Date: Oct. 4, 2007

(65) Prior Publication Data

US 2009/0272636 A1 Nov. 5, 2009

(30) Foreign Application Priority Data

Mar. 27, 2006 (EP) ..... 06111748

(51) Int. Cl.
*H01H 1/06* (2006.01)

(52) U.S. Cl. ..... 200/279; 439/886

(58) Field of Classification Search ..... 200/279; 439/886

See application file for complete search history.

(56) References Cited

U.S. PATENT DOCUMENTS

| | | | | |
|---|---|---|---|---|
| 3,735,068 | A * | 5/1973 | Yanaga et al. | 200/512 |
| 3,773,993 | A | 11/1973 | Amsler | |
| 6,305,991 | B1 * | 10/2001 | Gerster | 439/801 |
| 7,365,280 | B2 * | 4/2008 | Nishikawa et al. | 200/279 |

FOREIGN PATENT DOCUMENTS

| | | | |
|---|---|---|---|
| DE | 3533890 | A1 | 4/1987 |
| FR | 2 732 508 | | 3/1995 |
| GB | 374 619 | A | 6/1932 |
| GB | 668 900 | A | 3/1952 |
| GB | 877 674 | A | 9/1961 |
| JP | 52 053278 | A | 4/1977 |
| JP | 58 012219 | A | 1/1983 |

* cited by examiner

*Primary Examiner* — Vanessa Girardi

(74) *Attorney, Agent, or Firm* — Carter, DeLuca, Farrell & Schmidt, LLP

(57) ABSTRACT

A contactor has two contact elements (1, 2) each having a contact member (3, 4) adapted to bear with the contact side (5, 6) thereof against a said contact side of the other contact member for enabling an electric current to flow between said to contact elements. The contact sides of both contact members are provided with serration's (11, 12) extending so that elongated ridge-like peaks (13) of serration's of one said contact side intersect such peaks of the other said contact side while forming a plurality of spots of mutual contact of these contact sides distributed over the area of said contact sides.

19 Claims, 2 Drawing Sheets

SERRATED CONTACT MEMBERS

TECHNICAL FIELD OF THE INVENTION AND PRIOR ART

This application is a national phase entry of PCT/EP2007/052802, filed Mar. 23, 2007, and claims priority thereto as well as to European Patent Application Serial No. 06111748.7, filed Mar. 27, 2006. Both of these applications are incorporated herein by reference.

The present invention relates to a contactor having two contact elements each having a contact member adapted to bear with the contact side thereof against a said contact side of the other contact member for enabling an electric current to flow between said two contact elements.

"Contactor" is here defined to comprise all types of devices having these characteristics. Thus, contactors being normally in a closed contact making position enabling an electric current to flow between the two contact elements thereof, and in which the two contact elements are not intended to be separated as long as a device, an apparatus or a plant to which the contactor belong operates correctly, are comprised. The invention is also directed to such contactors of the type intended to establish and break an electric current flow between the two contact elements during normal operation state of the contactor as well as contactors being in the open state more than in the closed state enabling an electric current flow between the two contact elements.

Furthermore, the contactor may have more than two contact elements and each contact element may have more than one said contact member. In fact, they have often six contact elements, two per phase of a three-phase network, with one contact member each.

The different types of operation of such contactors are normally indicated by using the standard IEC 947-4-1, in which for instance AC1 is the operation in which the contactor is connected to resistive loads and is normally in the closed state and AC3 is an operation in which the contactor is connected to motors and is opened and closed more often and where the risk of welding of the contacts is higher.

The invention is not restricted to any particular range of electric currents intended to flow between the two contact elements in the closed state of the contactor, but it is particularly directed to contactors designed to have an electric current flow between the contact elements exceeding 5 A.

There are different requirements which contactors have to fulfil to function well. One such requirement is that they should have a capability to break a current therethrough when opening and establishing the current therethrough when closing without being destroyed due to for instance high temperatures. The thermal properties of the contact members are also very important for the proper function of a contactor, and they are especially important for contactors intended to be closed for enabling an electric current flow between the contact elements thereof in the normal operation state of the contactor, and the present invention is primarily directed to these properties and thereby to contactors of that type, although these properties may also be interesting for other types of contactors.

A low contact resistance in the contact interface between the two contact members, i.e. where said contact sides bear against each other, is important for keeping the heat production ($P=RI^2$) as low as possible, but it is also important to efficiently transport the heat generated in the contact interface away for avoiding hot spots, which would result in an unacceptably high temperature.

Different types of arrangements have been done for making said contact sides of the two contact members extending in parallel with each other, but in reality it has turned out to be impossible to obtain a perfect parallelism in a series production of such contactors. A slight deviation of the orientation of the contact sides from a perfect parallelism results in one single, comparatively large contact point between said contact sides in the closed state of the contactor, which is a disadvantage with respect to a more distributed contact area between the contact members for several reasons. The efficiency of heat transport away from one single larger contact spot will be lower than if the contact interface would be more distributed, which results in a totally higher temperature of the contact members in the contact surface, and this is getting hotter in the middle than at the outer borders thereof since the mid region is surrounded by hotter areas. The materials used for the contact members of such contactors has a positive temperature coefficient, which means that the resistance thereof increases with the temperature, and the current through the contactor has mostly to be kept constant, which means a further temperature increase in the contact surface having a high temperature resulting in a higher contact resistance than desired. Another problem of contactors of this type is that the contact members may be forced slightly apart when a current peak occurs, so that a movable one of the contact members is lifted away from the other contact member. This will then result in arcing which may cause welding and difficulties to open the contactor again.

SUMMARY OF THE INVENTION

The object of the present invention is to provide a contactor of the type defined in the introduction which addresses the problem described above.

This object is according to the invention obtained by providing such a contactor in which said contact sides of both contact members are provided with serrations extending so that elongated ridge-like peaks of serrations of one said contact side intersect such peaks of the other said contact side while forming a plurality of spots of mutual contact of these contact sides distributed over the area of said contact sides.

This means that the contact surface between the two contact members will be formed by many small contact surfaces or spots distributed over the area of the contact sides, so that the heat transport away from a total contact surface so created may be much more efficient than in the case of one single contact surface. Thus, in such spots all parts will be close to the outer border of the spot and no hotter mid regions with an increased resistance making them even hotter will result. This efficient heat transport will avoid too high temperatures at the contact interface between the contact members and any risk of destruction of the contact members. By arranging serrations in the contact sides of both contact members extending as defined above this distribution of the contact interface over a larger area of the contact sides may be obtained without any requirement of a perfect parallelism of the two contact sides with respect to each other. It is pointed out that "the area of said contact sides" means that said spots are distributed over the major part of the area of these contact sides, but they do not have to be distributed over the entire area thereof by being located also along the outer border of these contact sides. The (lifting) force $F_0$ trying to press the contact members apart upon occurrence of a current peak $I_0$ is for the case of one single contact point $k \cdot I_0^2$, whereas $k=4.45 \cdot 10^{-7}$. However it will for n contact, points be $F_n$ with the current $(I_0/n)$ in each contact point, in which $F_n=n \cdot k(I_0/n)^2=F_0/n$. Thus, the total force (~1/n) will be considerably reduced when the number of contact points increases reducing the risk of severe arcing and welding caused thereby. The lower lifting force also allows the use of less energy to close the contactor also resulting in less welding.

According to an embodiment of the invention said peaks of said serrations of the contact sides of the contact members have a substantially sharp edge, which facilitates the forming of said plurality of spots of mutual contact by cutting of said peaks into each other.

According to another embodiment of the invention the angle of the peaks of said serration is 50°-120°, advantageously 60°-90° and preferably approximately 70°. It has been found that especially an angle of approximately 70° is favourable both with respect to a proper operation of the contact members for establishing good contacts and for the strength of the serrations.

According to another embodiment of the invention the contactor comprises means adapted to press said contact elements with said contact sides of the contact members against each other by a pressure making said peaks of said serrations cutting into each other at intersections thereof for forming said spots of mutual contact, which results in a reliable forming of said plurality of spots of mutual contact even if the deviation of the orientation of the two contact sides from a perfect parallelism thereof would be substantial.

According to another embodiment of the invention said serrations have a depth of 0.2-2 mm, advantageously 0.3-1 mm, preferably 0.3-0.7 mm and most preferred approximately 0.5 mm. These depths, which together with the angle of the peaks of the serrations are of most importance for the distance between adjacent said spots of mutual contact, have turned out to be suitable.

According to another embodiment of the invention the serrations of the contact sides of one of the contact members extend in parallel with each other across said contact side. This constitutes a simple and efficient way of obtaining serrations having the properties aimed at, i.e. it is easy to obtain serrations of another contact side intersecting such serrations at spots being well distributed over the area of the contact sides. One way of obtaining this is by making the serrations of the contact sides of both contact members extending substantially in parallel with each other across the respective contact side, and orientate the serrations of the contact sides of the two contact members so that the peaks thereof make an angle exceeding 10°, advantageously 30°-90° and preferably approximately 90° with respect to each other. In the case of an angle of 90° a waffle-like contact pattern will be obtained (see FIG. 5 below).

According to another embodiment of the invention the serrations of the contact side of one of the contact members comprise concentrically extending rings of peaks and valleys, which constitutes one possible way of obtaining serrations able to obtain a distribution of spots of mutual contact of the contact sides by intersecting peaks of serrations of a contact side of another contact member.

Another possibility to obtain this is by providing a contact side of one of the contact members with serrations comprising peaks and valleys extending radially from a centre region of the contact side.

According to another embodiment of the invention the contact members are made of a silver and tin alloy such as a silver tin oxide, which is a suitable material being sufficiently hard for having a sufficiently high electrical wear resistance at the temperatures occurring and still sufficiently soft for making a good contact by a possibility to be partly deformed when the contact members are bearing against each other by a suitable pressure.

According to another embodiment of the invention the contactor comprises means for moving said contact elements with said contact members apart for separating said contact sides thereof and breaking the current flow between said contact elements.

According to another embodiment of the invention the contactor comprises means for moving said contact elements with said contact members from a position spaced apart preventing any electric currents from flowing between said contact elements towards each other to bear by said contact sides against each other and making an electric current to flow between said contact elements.

According to another embodiment of the invention said means for moving said contact elements apart or towards each other is adapted to move said contact elements with respect to each other along a substantial rectilinear path substantially perpendicular to the extension of said contact sides, which is favourable for establishing a physical contact between the contact members and breaking this contact.

According to another embodiment of the invention the contactor is designed to have an electric current to flow between said contact elements exceeding 5 A, advantageously exceeding 50 A, preferably being at least 500 A and most preferred 500 A-5000 A. The characteristics of a contactor according to the invention are particularly favourable for contactors intended to carry such currents in the closed state thereof.

According to another embodiment of the invention the contactor is of the type intended to be closed for enabling an electric current to flow between said contact elements in the normal operation thereof, for which contactors the present invention is most interesting, but according to another embodiment of the invention the contactor is of the type intended to establish and break said electric current flow between said contact elements during normal operation state of the contactor.

Other advantages and advantageous features of the invention will appear from the description below.

BRIEF DESCRIPTION OF THE DRAWINGS

With reference to the appended drawings below follows a specific description of embodiments of the invention cited as examples.

In the drawings.

DETAILED DESCRIPTION OF EMBODIMENTS OF THE INVENTION

Figure 1:
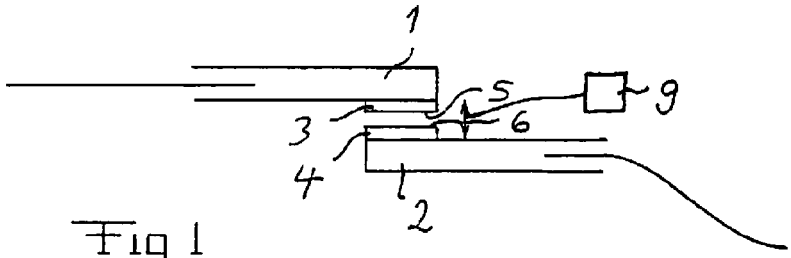
FIG. 1 is a very schematic view illustrating a contactor according to the invention in an open state.

FIG. 1 shows very schematically a contactor according to the present invention in an opened state. The contactor has two contact elements 1, 2 of a material with a high electric conductivity, such as Cu. These contact elements have a contact member 3, 4 each of a material suitable for making a contact with a low contact resistance, suitable hardness and other properties desired for the intended operation of the contactor. A suitable material for the contact members is for a contactor intended to be closed for enabling an electric current to flow between the contact elements in the normal operation state thereof a silver and tin alloy such as silver tin oxide (AgSnO). Other materials with similar properties are also conceivable, for instance silver cadmium oxide (AgCdO).

The contactor may be arranged in any type of electric path 5 for enabling an electric current to flow between the two contact elements 1, 2 when the contact members bear with a contact side 5, 6 against each other and breaking such an electric current path when the contact elements are spaced apart as shown in FIG. 1.

Figure 2:
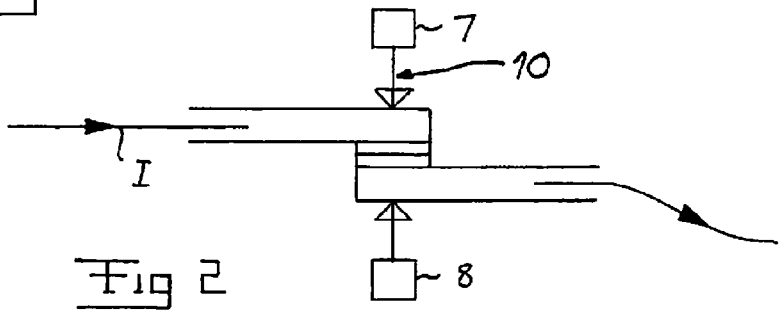
FIG. 2 is a view of the contactor according to FIG. 1 in a closed state.

FIG. 2 shows the contactor in the closed state in which the contact members 3, 4 bear with their contact sides against each other for enabling an electric current I to flow between the two contact elements 1, 2. It is shown how power means 7, 8, such as in the form of springs or the like, are arranged to press the contact elements with the contact sides of the contact members against each other by a pressure resulting in a good contact between the contact members. The contact sides 5, 6 of the contact members are in this state preferably substantially in parallel with each other, and it is preferred to arrange means 9, 10 for moving the contact element with respect to each other to move the contact elements according to a substantially rectilinear path according to a translational movement between the positions shown in FIGS. 1 and 2, i.e. between the opened and closed state.

Figure 3:
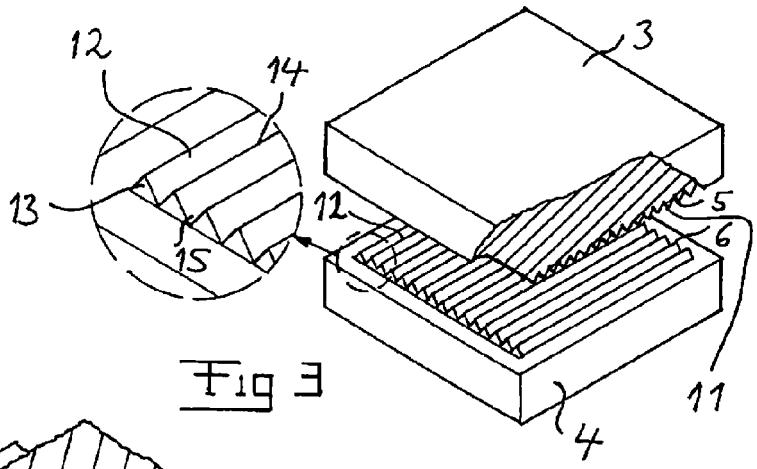
FIG. 3 is a view illustrating the contact sides of the two contact members of a contactor according to a first embodiment of the invention.

FIG. 3 shows the design of the contact sides 5, 6, and these are each provided with serrations 11, 12 extending in parallel with each other across the respective contact side. These serrations have ridge-like peaks 13 with sharp edges 14 separated by valleys 15. The depths of the serrations, i.e. the level of the bottom of the valley with respect to said edge 14, is approximately 0.5 mm, and the angle of the peaks is approximately 70°. Furthermore, the contact sides have in the present case a dimension of approximately 20 mm×20 mm.

The serrations of the contact sides of the two contact members are orientated so that the peaks thereof make an angle of approximately 90° with respect to each other, i.e. the serrations 11 of the contact side 5 extend substantially perpendicularly to the extension of the serrations 12 of the contact sides 6.

Figure 4:
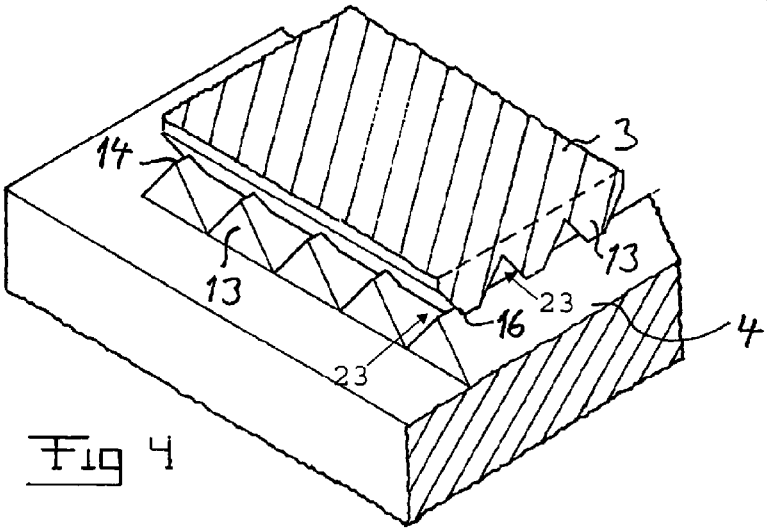
FIG. 4 is an enlarged view illustrating how the contact sides of the contact members according to FIG. 3 make contact with each other.

FIG. 4 schematically illustrates what happens when the contact members 3, 4 are pressed with the contact sides 5, 6 according to FIG. 3 with a certain pressure against each other. The peaks of the serrations of one contact side intersect peaks of the other said contact side while forming spots 16 of mutual contact at the locations of the intersections while retaining a plurality of interconnecting open passages 23 between respective serrations which facilitate the transportation of heat away from contact members 3, 4. The sharp edges of the peaks in combination with a suitable pressure of the contact members against each other as well as the choice of the material for the contact members improve this formation of spots of mutual contact by making said peaks cutting into each other at intersections thereof.

Figure 5:
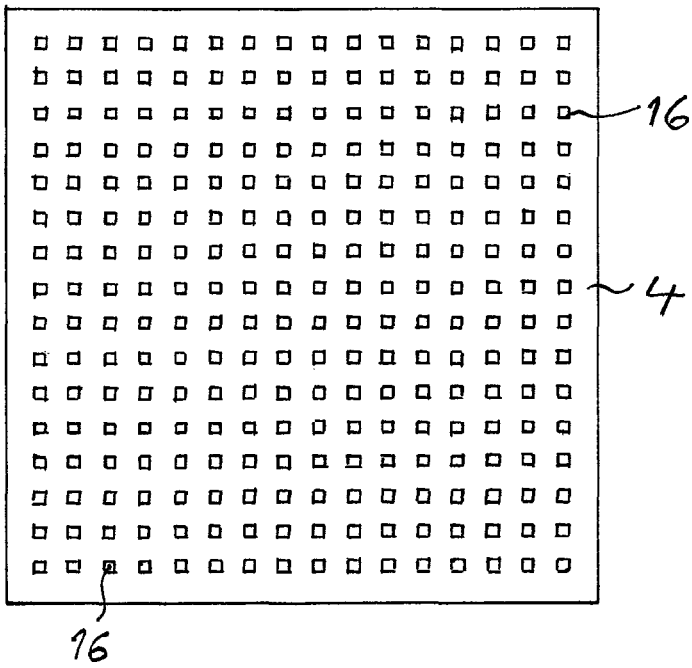
FIG. 5 is a view illustrating the plurality of spots of mutual contacts formed when the contact sides shown in FIG. 3 are brought to bear against each other.

FIG. 5 illustrates how spots 16 of mutual contact formed in this way will be distributed over the area of the contact sides when these contact sides have the design shown in FIG. 3. Each square spot 16 correspond to a spot of mutual contact. These spots will not get as hot as the mid region of a larger contact spot when the contactor has to conduct a current of a certain value, and the heat transfer away from the contact interface formed by said contact spots will be very efficient, so that the temperature of the contact members may for a determined current value be kept at an acceptable level avoiding high temperature problems of the contact members. Furthermore, the lifting force resulting from occurrence of current peaks as discussed above will also be considerably reduced, so that arcing and welding problems may be correspondingly reduced or eliminated.

Figure 6:
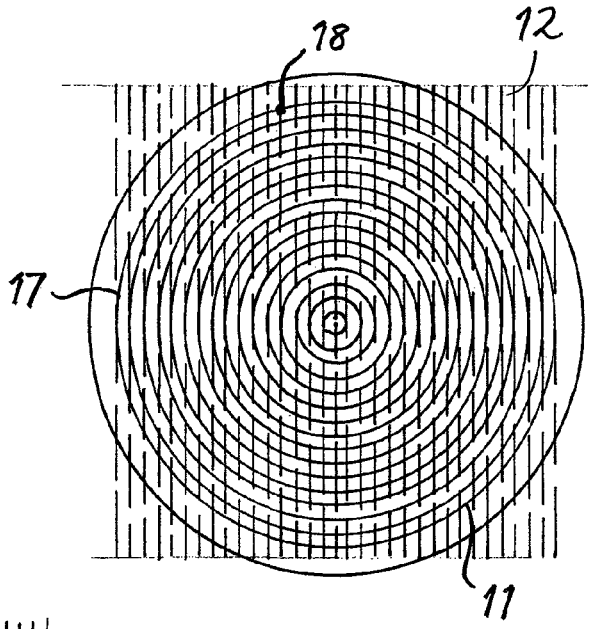
FIG. 6 is a view schematically illustrating the design of the contact sides of the contact members of a contactor according to a second embodiment of the invention.

FIG. 6 schematically illustrates another possibility to design the contact sides of the contact members for forming a plurality of spots of mutual contact of the contacts sides distributed over the area of the contact sides. One of the contact sides is here provided with serrations comprising concentrically extending rings 17 of peaks and valleys, whereas the other contact side has serrations extending in parallel with each other across the contact side. This means that spots of mutual contact will be formed at the intersections of the peaks, such as indicated at 18.

Figure 7:
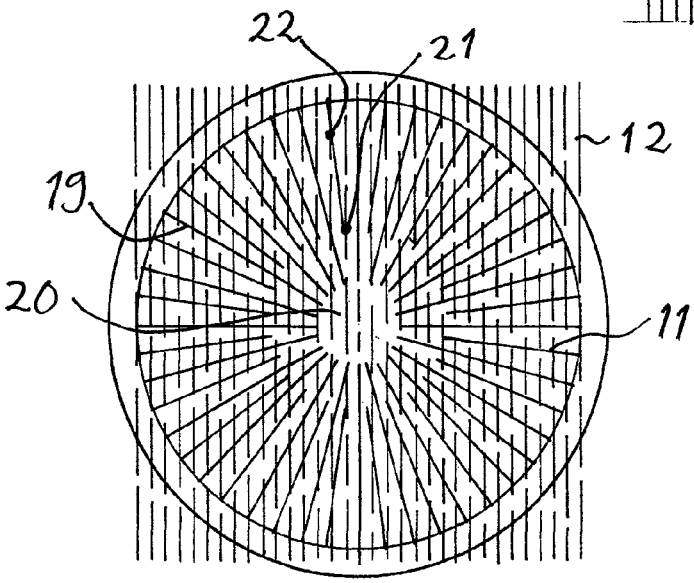
FIG. 7 is a view schematically illustrating the design of the contact sides of the contact members of a contactor according to a third embodiment of the invention.

FIG. 7 shows yet another possibility to obtain a formation of a plurality of spots of mutual contact of the contact sides distributed over the area of the contact sides. One contact side has in this case peaks 19 and valleys extending radially from a centre region 20 of the contact side, whereas the other contact side has serrations extending in parallel with each other across the contact side. Spots of mutual contact are here indicated at 21 and 22.

The different designs of the contact sides according to FIGS. 3, 6 and 7 may of course be combined with each other for obtaining suitable locations of intersections of peaks of the serrations and thereby spots of mutual contact.

The invention is not in any way restricted to the embodiments described above, but many possibilities to modifications thereof will be apparent to a person with ordinary skill in the art without departing from the basic idea of the invention as defined in the appended claims.

It is for instance possible to orientate the contact members shown in FIG. 3 so that the serrations make an angle differing from 90°, such as being for instance 45°, with respect to each other.

The invention claimed is:

1. A contactor, comprising:

two contact elements, each contact element having a contact member, said contact members of each contact element being engagable with one another to enable an electric current to flow between said two contact elements, said contact members including serrations extending into elongated ridge-like peaks such that said serrations of one contact member engage peaks of the other said contact member forming an array of mutual contact spots while retaining a plurality of interconnecting open passages between respective serrations which facilitate the transportation of heat away from said contact members.

2. The contact of claim 1, wherein at least one of the two contact elements are movable to selectively permit the flow of electric current therethrough.

3. The contact of claim 2, wherein the flow of electric current exceeds 5 A.

4. A contactor for selectively permitting flow of electric current exceeding 5 A therethrough, the contactor comprising:

two contact elements, at least one of said two contact elements being selectively movable relative to the other contact element between a closed state, in which electric current exceeding 5 A flows between said two contact elements, and an open state, in which no current flows between said two contact elements, each contact element having a contact member adapted to bear with a contact side thereof against a said contact side of the other contact member for enabling an electric current exceeding 5 A to flow between said two contact elements when in said closed state, wherein said contact sides of both contact members are provided with serrations extending into elongated ridge-like peaks such that said serrations of one said contact side cut into such peaks of the other said contact side forming an array of mutual contact spots distributed over both contact sides while retaining a plurality of interconnecting open passages between respective serrations which facilitate the transportation of heat away from said contact members and maintain said contact members at a predetermined temperature when said electric current is flowing between said two contact elements to avoid undesirable temperature levels of said contact members.

5. A contactor for selectively permitting flow of electric current exceeding 5 A therethrough, the contactor comprising:

two contact elements each having a contact member adapted to bear with a contact side thereof against a said contact side of the other contact member for enabling an electric current to flow between said two contact elements when said two contact elements are in a closed state, at least one of said two contact elements being selectively movable relative to the other contact element to dispose said contact elements between said closed state, in which electric current exceeding 5 A flows between said two contact elements, and an open state, in which no current flows between said two contact elements, said contact sides of both contact members including serrations extending to elongated ridge-like peaks, said peaks of one said contact side intersect said peaks of the other said contact side while retaining a plurality of interconnecting open passages between respective serrations which facilitate the transportation of heat away from said contact members; and means for selectively pressing said contact elements with said contact sides of the contact members against each other such that said peaks of said serrations cut into each other at intersections thereof for forming said spots of mutual contact.

6. A contactor according to claim 1, wherein said contact members are made of a silver and tin alloy, such as a silver tin oxide.

7. A contactor according to claim 5, wherein said serrations have a depth of between about 0.2 mm and about 2 mm.

8. A contactor according to claim 5, wherein the serrations of the contact sides of one of the contact members extend in parallel with each other across said contact side.

9. A contactor according to claim 5, wherein the serrations of the contact side of both contact members extend substantially in parallel with each other across the respective contact side, and that the serrations of the contact sides of the two contact members are orientated so that the peaks thereof make an angle exceeding at least about 10°.

10. A contactor according to claim 5, wherein the serrations of the contact side of one of the contact members comprise concentrically extending rings of peaks and valleys.

11. A contactor according to claim 5, wherein the serrations of the contact side of one of said contact members comprise peaks and valleys extending radially from a center region of said contact side.

12. A contactor according to claim 1, wherein said contact members are made of a silver and tin alloy, such as a silver tin oxide.

13. A contactor according to claim 1, further comprising means for moving said contact elements with said contact members from a position spaced apart preventing any electric current from flowing between said contact elements towards each other to bear by said contact sides against each other and making an electric current to flow between said contact elements.

14. A contactor according to claim 1, further comprising means for moving said contact elements with said contact members apart for separating said contact sides thereof and breaking the electric current flow between said contact elements.

15. A contactor according to claim 14, wherein said moving means is adapted to move said contact elements with respect to each other along a substantially rectilinear path substantially perpendicularly to the extension of said contact sides.

16. A contactor according to claim 5, wherein said peaks of said serrations of the contact sides of the contact members have a substantially sharp edge.

17. A contactor according to claim 16, wherein said contact members are made of a silver and tin alloy, such as a silver tin oxide.

18. A contactor according to claim 16, wherein the angle of the peaks of said serrations is between about 50° and about 120°.

19. A contactor according to claim 18, wherein said contact members are made of a silver and tin alloy, such as a silver tin oxide.

* * * * *